US006374517B2

(12) United States Patent
Girard et al.

(10) Patent No.: US 6,374,517 B2
(45) **Date of Patent: *Apr. 23, 2002**

(54) SOLE FOR A SPORT BOOT AND A SPORT BOOT INCLUDING SUCH SOLE

(75) Inventors: Francois Girard, Veyrier du Lac; Eric Girault, Sevrier, both of (FR)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/181,329

(22) Filed: Oct. 28, 1998

Related U.S. Application Data

(63) Continuation-in-part of application No. 09/014,248, filed on Jan. 27, 1998, now Pat. No. 5,924,719, which is a continuation of application No. 08/426,868, filed on Apr. 24, 1995, now abandoned, which is a continuation-in-part of application No. 08/729,520, filed on Oct. 11, 1996, now Pat. No. 6,017,050.

(30) Foreign Application Priority Data

| | | |
|---|---|---|
| Apr. 29, 1994 | (FR) | 94 05406 |
| Oct. 16, 1995 | (FR) | 95 12418 |
| Oct. 29, 1997 | (FR) | 97 13749 |

(51) Int. Cl.[7] ..... A43B 5/04; A43B 5/16; A63C 9/00; A63C 9/08

(52) U.S. Cl. ..... 36/117.3; 36/117.2; 36/115; 36/116; 280/615; 280/625

(58) Field of Search ..... 36/116, 115, 117.1, 36/117.2, 117.3; 280/615, 614, 625, 634

(56) References Cited

U.S. PATENT DOCUMENTS

| | | | | |
|---|---|---|---|---|
| 4,353,576 A | * 10/1982 | Salomon | 280/615 |
| 4,808,134 A | * 2/1989 | Imbeault | 36/117.3 |
| 4,959,913 A | * 10/1990 | Provence et al. | 36/117.3 |
| 4,997,198 A | * 3/1991 | Provence et al. | 36/117.3 |
| 5,108,125 A | 4/1992 | Callegari | 280/615 |
| 5,369,897 A | * 12/1994 | Rullier | 36/117.3 |
| 5,671,941 A | 9/1997 | Girard | 280/615 |
| 5,794,963 A | 8/1998 | Girard | 280/615 |

FOREIGN PATENT DOCUMENTS

| | | | |
|---|---|---|---|
| DE | 3738206 | * 5/1988 | 280/615 |
| DE | 263916 | * 1/1989 | 36/115 |
| EP | 129535 | * 12/1984 | 36/117.2 |
| EP | 359964 | * 3/1990 | 36/117.2 |
| EP | 768103 | * 4/1997 | 36/117.3 |
| FR | 2556569 | * 6/1985 | 36/117.2 |
| FR | 2582531 | * 12/1986 | 280/615 |
| FR | 2719229 | * 11/1995 | |
| FR | 2739788 | 4/1997 | |
| SU | 1042764 | * 8/1983 | 280/615 |

* cited by examiner

*Primary Examiner*—Anthony Stashick
(74) *Attorney, Agent, or Firm*—Greenblum & Bernstein, P.L.C.

(57) ABSTRACT

A sport boot sole of the type having on its lower surface two connecting members, offset one with respect to the other in the longitudinal direction of the boot, and arranged substantially transversely, wherein the first connecting member is arranged in the area of the front end portion, and the second connecting member is arranged behind the first connecting member, and substantially in front of the metatarsophalangeal articulation zone (Δ). Advantageously, the first connecting member is arranged in the area of the front end portion of the toes or right in front of this end portion.

30 Claims, 1 Drawing Sheet

SOLE FOR A SPORT BOOT AND A SPORT BOOT INCLUDING SUCH SOLE

CROSS-REFERENCE TO RELATED APPLICATIONS

This is a continuation-in-part of patent application No. 09/014,248, filed on Jan. 27, 1998, now U.S. Pat. No. 5,924,719, which is a continuation of patent application No. 08/426,868, filed on Apr. 24, 1995, now abandoned, the priorities of both applications being claimed under 35 USC 120, and, for both applications, the priority of French application No. 94.05406, filed on Apr. 29, 1994, is claimed under 35 USC 119.

This is also a continuation-in-part of patent application No. 08/729,520, filed on Oct. 11, 2996, now U.S. Pat. No. 6,017,050, issued on Jan. 25, 2000, the priority of which is being claimed under 35 USC 120 and the priority of FR 95.12418, filed on Oct. 16, 1995, is claimed under 35 USC 119.

BACKGROUND OF THE INVENTION

1. Field of the Invention

The present invention relates to the design of sport boots, especially gliding sports, such as cross-country skiing or skating, or other sports, such as biking, in which the boot must be attached to the sport article while preserving a possibility of foot movement during the practice of the sport.

2. Description of Background and Material Information

In the aforementioned sports, and especially in cross-country skiing, different methods of fastening the boot to the sport article have been investigated.

Thus, the conventional binding method consists in attaching the boot to the cross-country ski by means of a stirrup cooperating with a front overlapping part of the sole and pressing this part against the cross-country ski.

Such a binding method prevents the complete movement of the foot since the foot is attached to an entire front part.

To overcome this drawback, different systems have been proposed to articulate the boot on the cross-country ski around an axle attached transversely to the boot.

Different positions of this axle, at the front of the boot, at the level of the metatarsal zones, etc., have been tested with a more or less degree of satisfaction.

The problem, in fact, is that while preserving a comfort of use, a compromise must be found between two completely contradictory requirements, namely:

- a maximum movement or lifting of the foot, necessary for obtaining a great impulse or a wide stride, depending on the sport practiced, which implies a certain flexibility of the sole during bending, this flexibility varying according to the type of sport practiced; and
- an optimum control and steering of the gliding member or sport article which, in theory, can only be obtained through a permanent "contact" between the foot and the former, and/or a certain torsional rigidity of the sole, and therefore it is not compatible with a flexion or movement of the foot.

This problem was partially resolved in the document FR 2 739 788, which provides an assembly of a boot and a device for binding a boot to a sport article, in which the boot has two anchoring means constituted by transverse axles arranged, one at the front of the boot, and the other substantially in the area of the metatarsophalangeal articulation zone, and in which the binding device is provided so as to allow the rotation of the boot around the first anchoring axle and to exert a constant elastic return on the second anchoring axle in the direction of the sport article.

Thus, providing means for the elastic return of the boot towards the sport article, not at the front of the boot as in currently known devices, but at the rear of the binding devices of the boot, allows controlling the boot with respect to the gliding member even when the boot is raised.

Such a boot/binding system therefore allows reconciling the problems of lifting and control/steering of the boot with respect to the sport article, and therefore allows, in principle, an optimum movement of the foot.

The document FR 2 739 788 provides a positioning of the second transverse axle in the area of the metatarsophalangeal articulation zone.

However, experience shows that a positioning of such an axle right at the level of this articulation poses problems concerning comfort, since the flexion of the foot at this level occurs around a hard spot.

The positioning of the first axle is not obvious either. Indeed, the more this axis is positioned towards the front, the greater the clearance, but if this axle is arranged too far towards the front, the movement of the foot will be hindered since the athlete will not have the feeling of a pure rotation.

On the other hand, the movement will not be optimum either if the first axle is placed too far back with respect to the end portion of the boot.

SUMMARY OF THE INVENTION

An object of the present invention, therefore, is to overcome the aforementioned drawbacks and to propose a sole for a sport boot that reconciles the requirements for control movement/foot steering without having a negative effect on comfort.

This object is achieved in the sport boot sole according to the invention which is of the type having, on its lower surface, two connecting members offset one with respect to the other in the longitudinal direction of the boot and arranged substantially transversely, whereby the first connecting member is arranged in the area of the front end portion, and the second connecting member is arranged behind the first connecting member, and substantially in front of the metatarsophalangeal articulation zone.

Indeed, it is guaranteed through this arrangement that the second connecting member will only operate at the end of a rolling movement on the metatarsophalangeal articulation; consequently, it will not hinder this movement.

According to a preferred embodiment, the first connecting member is arranged in the area of the front end portion of the toes or right in front of this end portion.

Such an arrangement also allows guaranteeing a rolling movement on the toes without the presence of hard spots.

BRIEF DESCRIPTION OF DRAWINGS

The invention will be more clearly understood and other characteristics thereof will become apparent with reference to the following description and the annexed drawings, in which.

DETAILED DESCRIPTION OF THE INVENTION

Figure 1:
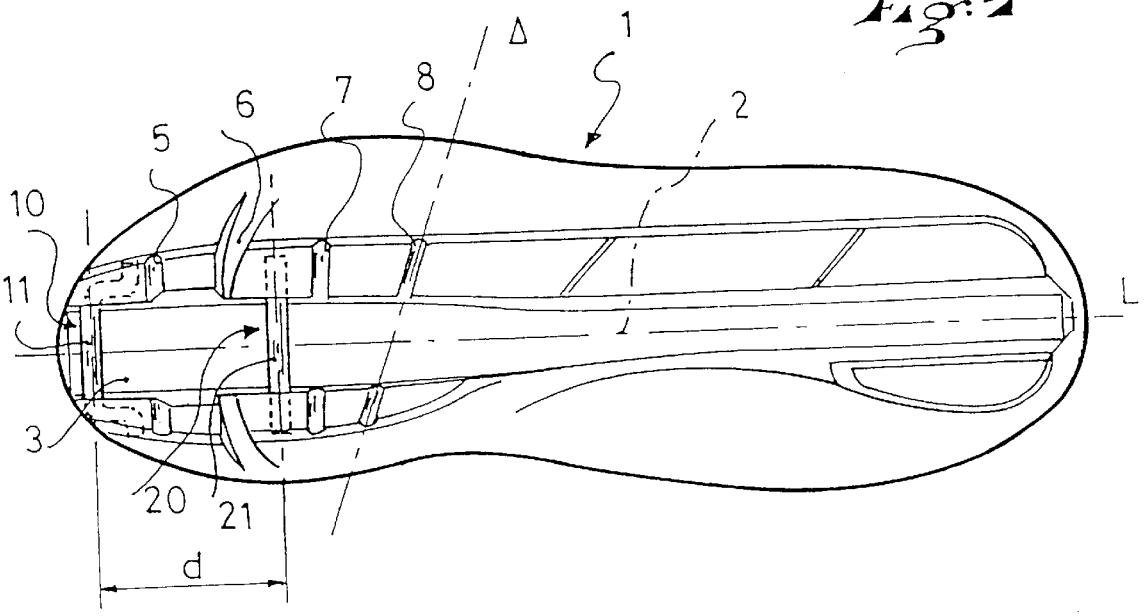
FIG. 1 is a bottom view of a sole according to the invention.

The sole designated by the reference numeral 1 in the figures has a guiding groove 3 with a substantially rectangular transverse section, arranged along the longitudinal axis 2 of the sole and receiving two transverse pins or axles, constituting two connecting members, respectively, front 10 and rear 20.

As shown in FIG. 1, the first axle 10 is arranged in the area of the front end portion of the sole, whereas the second axle 20 is arranged in front of the metatarsophalangeal journal axis Δ. As seen in FIG. 1, the sole 1 defines an outer periphery, within which both the front and rear connecting members 10 and 20 are contained.

Figure 2:
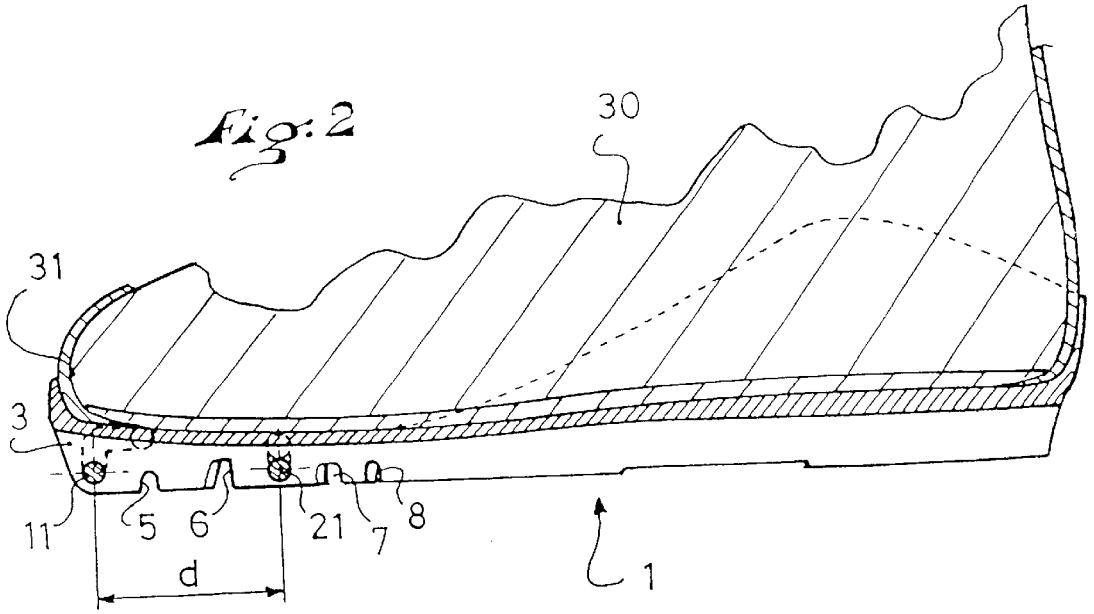
FIG. 2 is a longitudinal cross sectional view of FIG. 1.

Preferably, the first axle 10 is arranged in the area of the front end portion of the toes. FIG. 2 shows that the front connecting member 10 is positioned beneath the front end of the upper and not forward of the front end thereof.

In practice, this position is predetermined by the end portion of the assembly form used to constitute the boot upper during manufacturing. This form is shown as 30 in FIG. 2, as well as the relative position of the axle 10 with respect to its end portion 31.

The second axle 20 is arranged behind the first axle 10, in the longitudinal direction and so as to be in front of the metatarsophalangean journal axis Δ.

This position is shown particularly in FIG. 1.

In practice, for sizes equal to or greater than the mondopoint size 23 (i.e., a size corresponding to a foot length of 230 mm), a distance "d", between the two axles 10 and 20 and equal to 50 mm or about 50 mm, allows meeting this requirement and reconciling a freedom of foot movement while preserving a satisfactory steering.

According to preferred embodiments or connecting members, the axles 10, 20 are anchored independently with respect to each other in the boot so as not to hinder the flexion of the sole.

Likewise, downwardly open transversely extending flexion slots 5, 6, 7, 8 can be provided between the two axles 10, 20, and behind the second axle 20 for sole flexibility.

It is noted that the position of the connecting parts 10, 20 at the front of each journal zone of the foot allows avoiding the formation of hard spots during foot movement, and therefore ensures a perfect comfort for the user.

The present invention is not limited to the only embodiment described herein by way of non-limiting example, but it covers all equivalent embodiments.

It also applies to all types of sport boots in which similar or equivalent problems must be resolved.

The instant application is based upon the French Patent Application No. 97 13749, filed Oct. 29, 1997, the disclosure of which is hereby expressly incorporated by reference thereto in its entirety, and the priority of which is hereby claimed under 35 USC §119.

What is claimed is:

1. A sport boot sole comprising:

a sole extending in a longitudinal direction between a front end and a rear end, said sole having a lower surface and a metatarsophalangeal articulation zone, said sole defining a sole periphery; and two connecting members in said lower surface of connecting said sole to a sport article, said two connecting members extending transversely of said longitudinal direction, said two connecting members comprising a first connecting member and a second connecting member, said first connecting member being positioned within a vertical projection of said sole periphery as said sole is supported upon a horizontal surface, said second connecting member being positioned rearward of said first connecting member and rearward of said front end of said sole, said second connecting member constituting a rearwardmost connecting member, said second connecting member being positioned in front of said metatarsophalangeal articulation zone.

2. A sole according to claim 1, wherein:

said first connecting member is arranged in an area of a front end portion of said sole.

3. A sole according to claim 2, wherein said first connecting member is arranged in an area of a front end portion of an assembly form of the boot.

4. A sole according to claim 1, wherein:

said second connecting member being positioned substantially in front of said metatarsophalangeal articulation zone.

5. A sole according to claim 1, wherein:

said first connecting member is arranged in a front end portion of said sole.

6. A sole according to claim 1, wherein:

said first and second connecting members are anchored independently in said sole.

7. A sole according to claim 1, wherein:

each of said first and second connecting members is constituted by a transverse pin.

8. A sole according to claim 1, further comprising:

at least one flexion slot is provided in said slot in an area of each connecting member.

9. A sole according to claim 1, further comprising:

at least one downwardly open transversely extending flexion slot is positioned between said first and second connecting members and at least one downwardly open transversely extending flexion slot is positioned rearward of said second connecting members.

10. A sport boot comprising a sole according to claim 1.

11. A boot sole according to claim 1, further comprising:

a longitudinally extending guiding groove;

each of said first and second connecting members is anchored to have a respective portion extending across said groove.

12. A sole according to claim 1, wherein;

said two connecting members are disconnected from the sport article.

13. A boot sole according to claim 1, wherein:

said second connecting member is positioned rearward of said first connecting member by about 50 mm.

14. A boot sole according to claim 13, further comprising:

a longitudinally extending guiding groove;

each of said two connecting members is anchored to have a respective portion extending across said groove.

15. A boot comprising a sole according to claim 13.

16. A sole according to claim 13, wherein:

said two connecting members are disconnected from the sport article.

17. A boot sole comprising:

a sole extending in a longitudinal direction between a front end and a rear end, and a metatarsophalangeal articulation zone between said front and rear ends, said sole defining a sole periphery;

a front connecting member and a rear connecting member, said front and rear connecting members being offset in said longitudinal direction and being fixed to said sole and having respective portions extending from respective portions of said sole allow connection to a binding device of a sport article;

said front connecting member being positioned within a vertical projection of said sole periphery, as said sole is supported upon a horizontal surface;

said rear connecting member being rearward of said front end of said sole and constituting a rearwardmost connecting member, said rear connecting member being positioned in front of said metatarsophalangeal articulation zone.

18. A boot sole according to claim 17, wherein:

said two connecting members extend transversely of said longitudinal direction.

19. A boot sole according to claim 17, wherein:

said front connecting member and said rear connecting member are longitudinally offset by about 50 mm.

20. A boot sole according to claim 17, further comprising:

a longitudinally extending guiding groove;

each of said front and rear connecting members is anchored to have a respective portion extending across said groove.

21. A boot comprising a sole according to claim 17.

22. A sole according to claim 17, wherein:

said front and rear connecting members are disconnected from the binding device of the sport article.

23. A boot sole according to claim 17, wherein:

said front and rear connecting members are anchored independently in said sole.

24. A spot boot comprising:

an upper having a front end; and a sole affixed beneath said upper and extending in a longitudinal direction between a front end and a rear end, and a metatarsophalangeal articulation zone between said front and rear ends;

a front connecting member and a rear connecting member, said front and rear connecting members being offset in said longitudinal direction and fixed to said sole and having respective portions extending from respective portions of said sole to allow connection to a binding device of a sport article.

said front connecting member being positioned beneath and at or rearward of said front end of said upper ;

said rear connecting member being rearward of said front end of said sole and constituting a rearwardmost connecting member.

25. A sport boot according to claim 24, wherein:

said rear connecting member being positioned in front of said metatarsophalangeal articulation zone.

26. A sport boot according to claim 24, wherein:

said two connecting members extend transversely of said longitudinal direction.

27. A sport boot according to claim 24, wherein:

said front connecting member and said rear connecting member are longitudinally offset by about 50 mm.

28. A sport boot according to claim 24, further comprising:

a longitudinally extending guiding groove;

each of said front and rear connecting members is anchored to have a respective portion extending across said groove.

29. A sole according to claim 24, wherein:

said front and rear connecting members are disconnected from the binding device of the sport article.

30. A sport boot according to claim 24, wherein:

said front and rear connecting members are anchored independently in said sole.

* * * * *